US010655311B1

(12) United States Patent
Murphy

(10) Patent No.: US 10,655,311 B1
(45) Date of Patent: May 19, 2020

(54) DRAINAGE SYSTEM FOR A SINK

(71) Applicant: Marvin Murphy, San Clemente, CA (US)

(72) Inventor: Marvin Murphy, San Clemente, CA (US)

( * ) Notice: Subject to any disclaimer, the term of this patent is extended or adjusted under 35 U.S.C. 154(b) by 0 days.

(21) Appl. No.: 16/194,619

(22) Filed: Nov. 19, 2018

(51) Int. Cl.
*E03C 1/182* (2006.01)
*E03C 1/22* (2006.01)

(52) U.S. Cl.
CPC ..... *E03C 1/182* (2013.01); *E03C 1/22* (2013.01)

(58) Field of Classification Search
CPC ..... E03C 1/182; E03C 1/22
USPC ..... 4/629
See application file for complete search history.

(56) References Cited

U.S. PATENT DOCUMENTS 163,869 A 6/1875 Holland
5,038,816 A * 8/1991 Weltsch ..... E03C 1/282 137/247.51
5,372,718 A * 12/1994 Zebian ..... B01D 29/117 210/301
9,574,335 B2 * 2/2017 Hancosky ..... E03C 1/282
9,932,727 B2 4/2018 Coronado et al.
2003/0163869 A1 * 9/2003 Bosch ..... E03C 1/284 4/679
2014/0130251 A1 * 5/2014 Yu ..... E03C 1/282 4/679

* cited by examiner

*Primary Examiner* — Huyen D Le
(74) *Attorney, Agent, or Firm* — Sanchelima & Associates, P.A.; Christian Sanchelima; Jesus Sanchelima

(57) ABSTRACT

The present invention is a drainage system for a sink that has a drainage pipe and a drainage box. Drainage pipe connects sink and drainage box and has a substantial portion longitudinal which occupies less space under sink and provide more useful area for stacking or storage. Drainage box is fitted under sink and eases periodic maintenances and chock up/article removal without the need to dismantle drainage pipe by providing an openable outlet. Drainage box includes an inlet hole for receiving drainage pipe which disburses liquid and solid wastes therewithin, an outlet hole which is in fluid communication with a drainage outlet provided on the wall for exit of liquid wastes and an openable outlet to remove solid wastes. Openable outlet is easy to open and hence eliminates the need for calling a plumber in event of chock up or for removing accidentally fallen articles such as rings.

6 Claims, 5 Drawing Sheets

DRAINAGE SYSTEM FOR A SINK

BACKGROUND OF THE INVENTION

1. Field of the Invention

The present disclosure relates to a drainage system. More particularly, the present disclosure relates to a drainage system for a sink that occupies less space and is easy to open in event of a chock up or removal of article accidentally fallen in sink and drainage pipeline.

2. Description of the Related Art

Drainage sinks are provided with P-shaped drainage pipes that occupy more space under drainage sink which otherwise can be used for other useful purposes like storing, stacking of objects/articles or positioning a trolley. Over a period of use, drainage pipes are likely to be clogged and need to be dismantled for cleaning. One needs to be dependent on a plumber for dismantling and cleaning. Dismantling and cleaning of drainage pipes is a tedious and time-consuming task. Hence, there is a need for a drainage system that occupies less space and is easy for cleaning without the need for dismantling.

Several designs for various drainage systems and pipelines have been designed in the past. None of them, however, includes a drainage system that requires less space and eliminates the need of dismantling of drainage pipes during periodic maintenance or cleaning.

Applicant believes that a related reference corresponds to a US granted patent application 20030163869 filed by LOUIS BOSCH for Clear View Drain. The Louis reference discloses a plug that is positioned in the bottom of the drainage pipe curve that permits easy access. However, the drainage pipe is required to have a curve shape which occupies more space.

Another related application is U.S. Pat. No. 9,932,727 by Coflex S. A. for a flexible drainage assembly. The patent '727 discloses a flexible drainage trap having a flexible portion that has a substantially smooth inner surface. However, the usage of flexible portion limits the life and needs to be periodically replaced.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a drainage system that has a drainage pipe with a substantial portion longitudinal and hence occupies less space under sink and provides more useful area for stacking or storage.

It is yet another object of the present invention to provide a drainage system that has a drainage box that eases periodic maintenances and chock up/article removal without the need to dismantle drainage pipe by providing an openable outlet.

It is still another object of the present subject matter to provide a drainage system that requires less time for cleaning and eliminates the need to depend on a plumber.

It is still another object of the present subject matter to provide a drainage system having a drainage box that is easy to install, open and clean.

It is still another object of the present subject matter to provide a drainage system that can be used in residential as well as commercial buildings.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
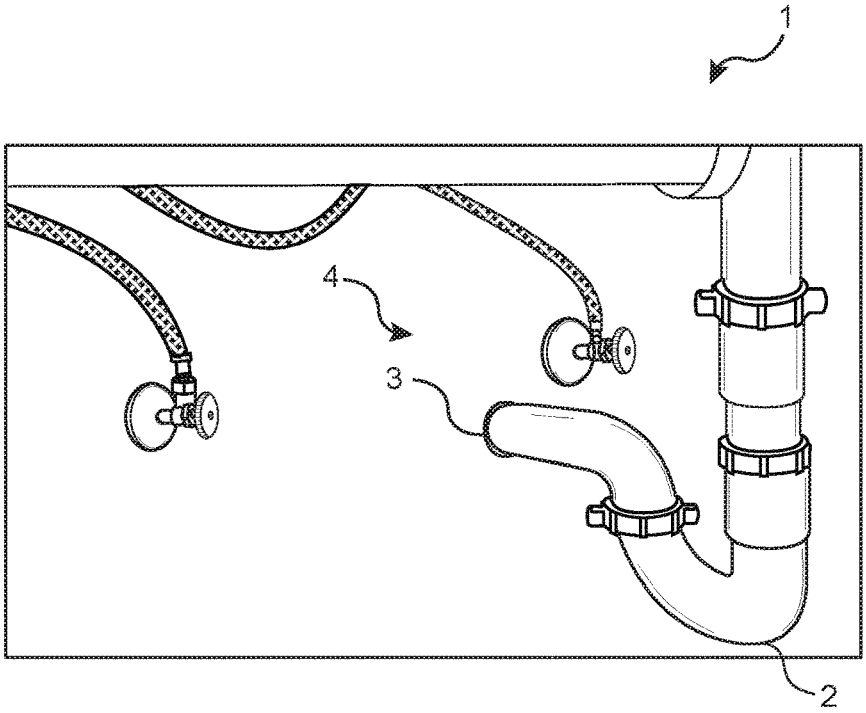
FIG. 1 Prior art
FIG. 1 represents an isometric view of a conventional drainage system 01 having a P-shaped drainage pipe 02 that occupies more space under a sink.
Figure 2:
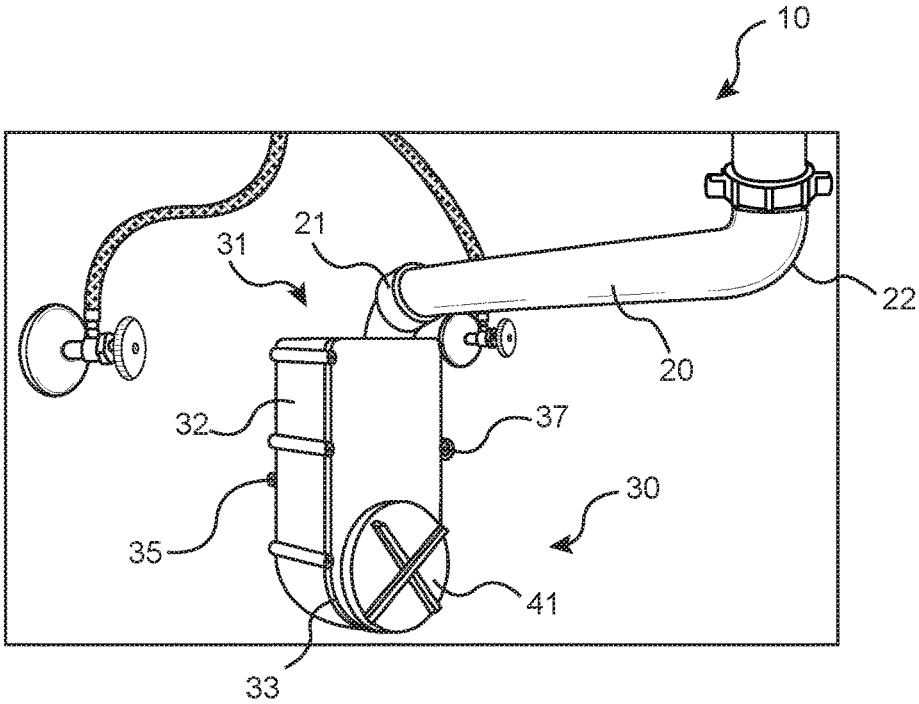
FIG. 2 represents a schematic isometric view of drainage system 10 of the present invention showing a drainage pipe 20 that has a substantial portion longitudinal and connected to a drainage box 30 that is easily openable to remove wastes or articles in event of a chock up or periodic maintenances.
Figure 3:
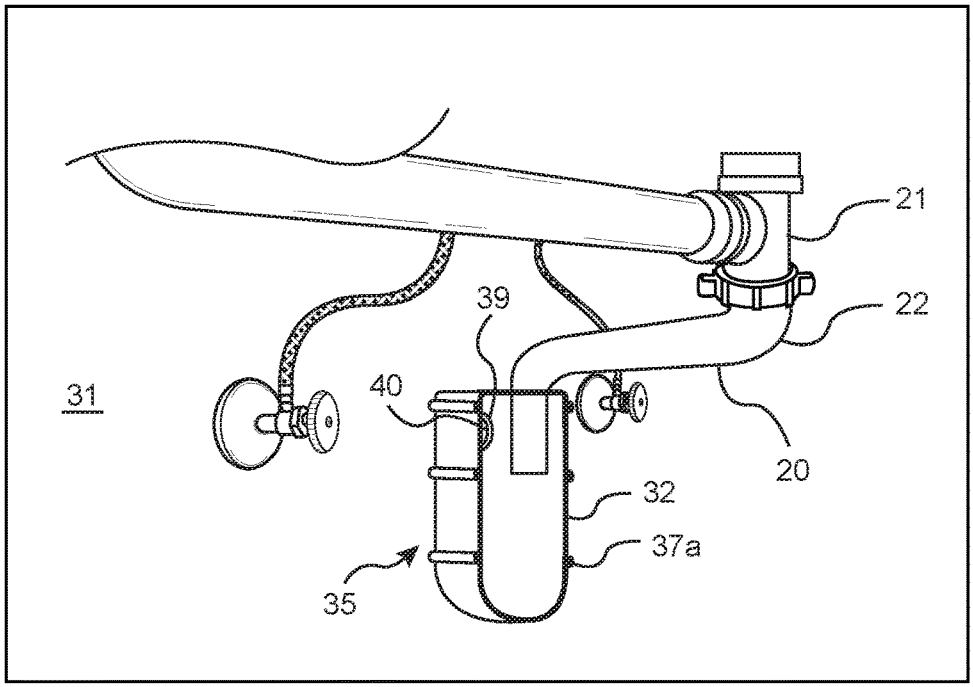
FIG. 3 shows another isometric view of drainage system 10 in which drainage box 30 is in an open configuration.
Figure 4:
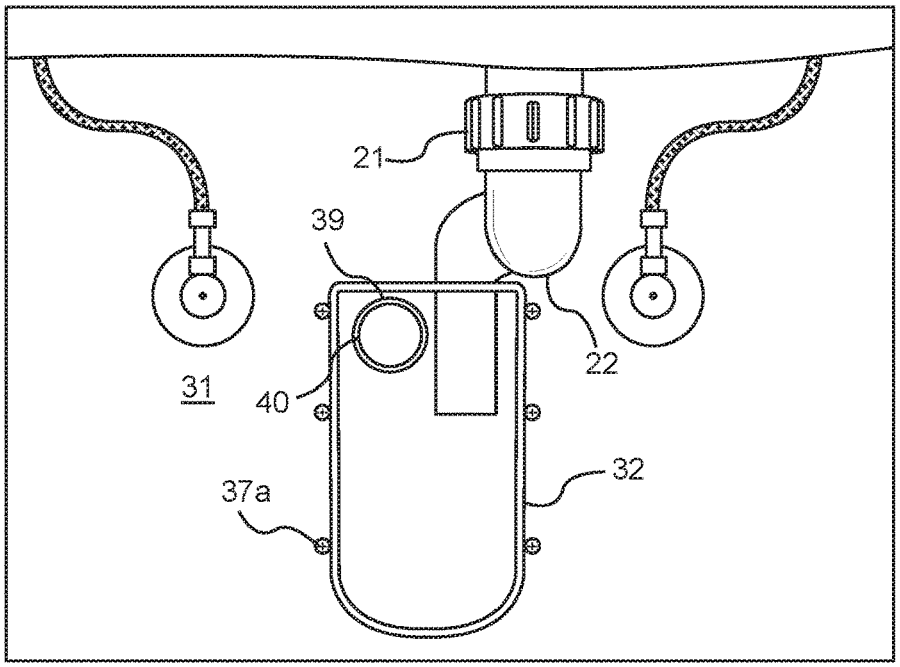
FIG. 4 illustrates a front view of drainage system 10 of FIG. 3.
Figure 5:
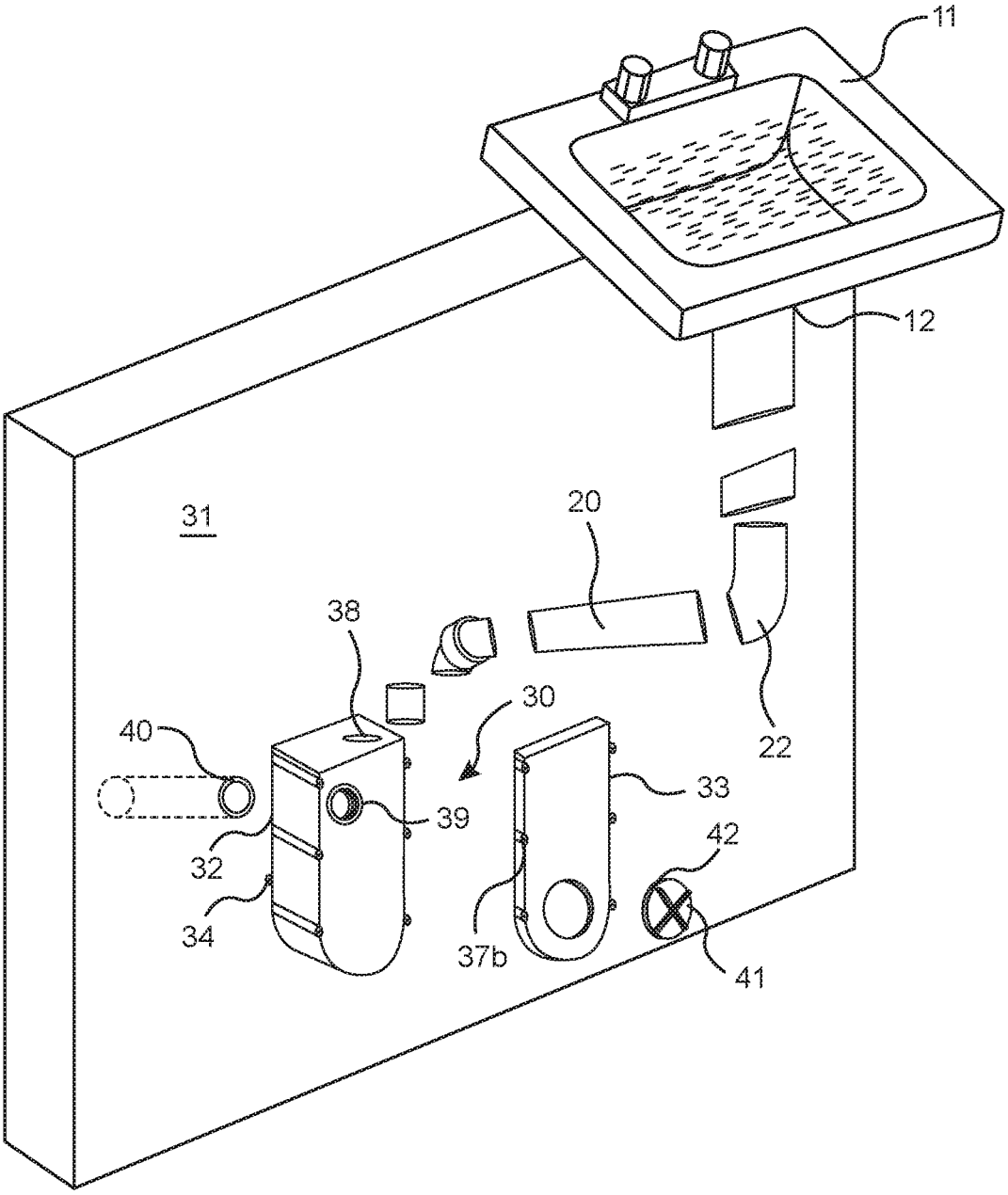
FIG. 5 illustrates an exploded view of drainage system 10.
Figure 6:
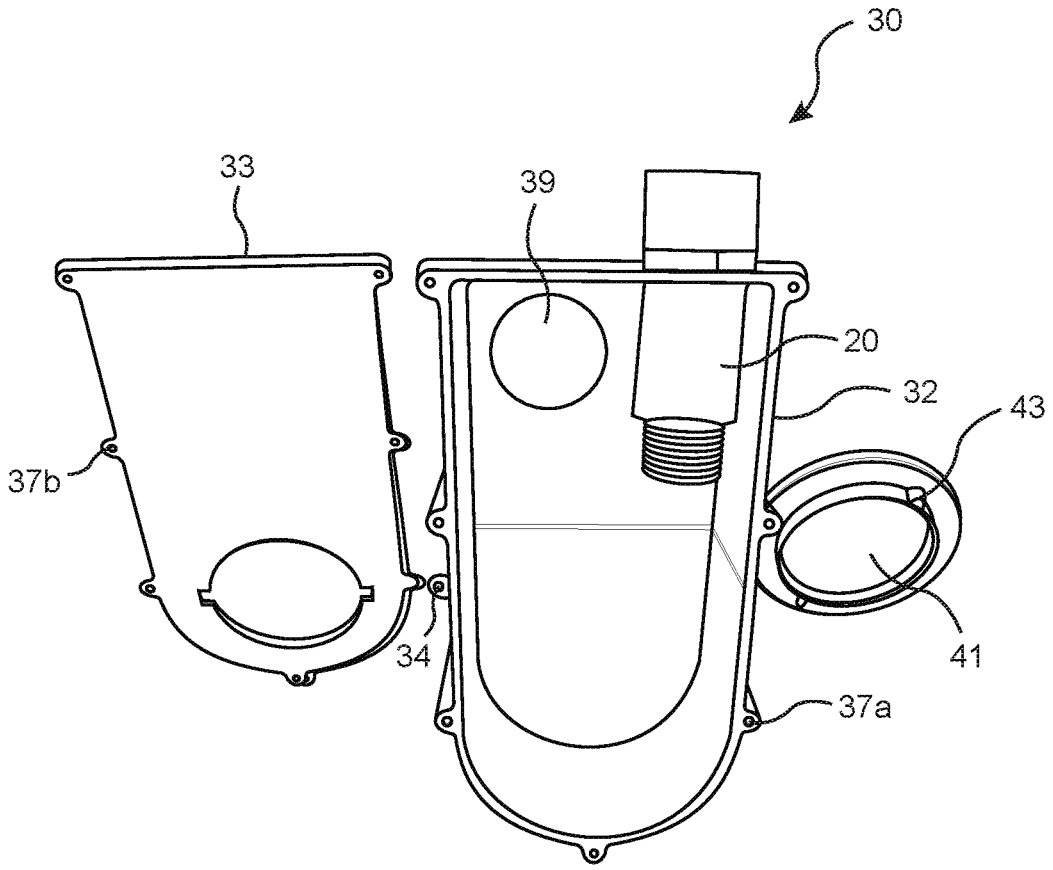
FIG. 6 illustrates an exploded view of drainage box 30.
Figure 7:
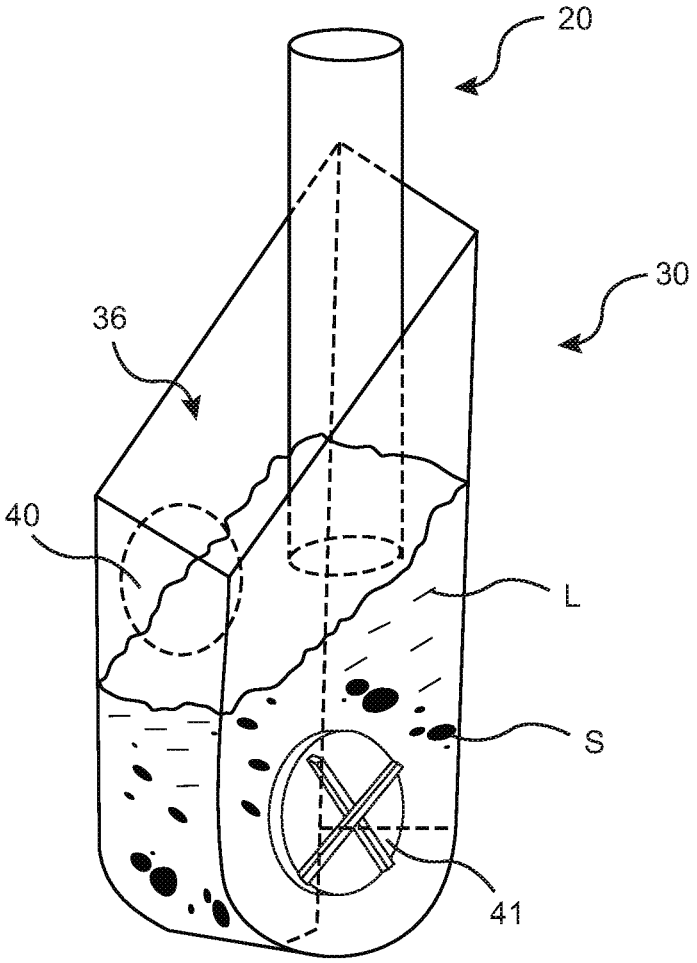
FIG. 7 illustrates an exemplary internal view of the drainage box 30 received with liquid wastes 'L' and solid wastes 'S' from the drainage pipe 20.

Referring now to the drawing, FIG. 1, where a conventional drainage system is generally referred to with numeral 01, it can be observed that a conventional drainage system includes a sink (not illustrated in Figures), a P-shaped drainage pipe 02 and a drainage outlet 03 provided on a wall 04. P-shaped drainage pipe 02 requires more space and needs to be dismantled in event of a chock-up or while removing a precious article like a hand ring that has been accidentally fallen in the sink and drainage pipe 02. Thus, one needs to be dependent on a plumber for dismantling drainage pipe 02. The process of dismantling is a time-consuming and tedious activity.

Referring now to the drawings, FIGS. 2-7, where the present invention is generally referred to with numeral 10, it can be observed that a drainage system for a sink 11, in accordance with one embodiment, is provided that mainly includes a drainage pipe 20 and a drainage box 30.

Drainage pipe 20 is connected to the outlet 12 of sink 11 and receives liquid wastes 'L' and solid wastes 'S' such as hairs, small sized food particles, sand, dirt or debris. Drainage pipe 20 has a major or substantial portion that is longitudinal. As there is no P-shape or U-shape bend of drainage pipe 20 and the major substantial portion is longitudinal, drainage pipe 20 does not occupy more space below the sink 11 as conventional drainage pipe 02 (as illustrated in FIG. 1) occupy and hence the free space can be used for other useful purposes such as placing a trolley, stacking items or containers.

In one embodiment, drainage pipe 20 is formed by assembling a plurality of pipes. Further, drainage pipe 20 includes at least one connector 21 that can be a straight connector, an elbow connector and/or like other connectors or combination of connectors. Drainage pipe 20 can also include at least one bend 22. Thus, drainage pipe 20 can be formed by one or number of pipes and/or by use of connectors or bends such that a substantial portion is longitudinal and eliminates P-shape or U-shape bend and drainage pipe 20 and connects outlet 12 of sink 11 and drainage box 30.

Drainage box 30 is fitted on a wall 31 underneath sink 11. In accordance with one embodiment, drainage box 30 includes a base 32 and a lid 33. Base 32 is fitted on wall 31. In one embodiment, base 32 is provided with a number of holes 34 through which fasteners 35 can be inserted to penetrate into wall 31 thereby clamping the base 32 with wall 31. Lid 33 covers base 32 to form a cavity 36 therebetween. Typically, fasteners 37 are used to clamp base 32 and lid 33 through respective holes 37*a* and 37*b*. Other types of clamps or locks that can connect and separate/lock base 32 and lid 33 are within the scope of the present disclosure. A hinge connection (not illustrated in Figures) can also be optionally provided between base 32 and lid 33.

Base 32 is provided with an inlet hole 38 that receives drainage pipe 20. Thus, drainage pipe 20 carries liquid wastes 'L" and solid wastes 'S' from sink 11 to the enclosed drainage box 30. Base 32 also includes an outlet hole 39 that is in-line and in fluid communication with a drainage outlet 40 provided on wall 31. Liquid wastes 'L' received in cavity 36 flows to drainage outlet 40 through outlet hole 39. Drainage outlet 40 is further connected to main drainage line (not illustrated in Figures). Lid 33 is configured with an openable outlet 41 that is a door. Solid wastes can be collected by opening openable outlet 41. While washing hands or utensils, a hand ring may accidentally fall in sink 11 and enter drainage pipe 20. In such condition, openable outlet 41 is opened and hand ring is removed. Thus, the need for dismantling drainage pipe 20 is eliminated. Also, opening of openable outlet 41 is an easy task and hence there is no need for calling a plumber. Openable outlet 41 can have a thread connection 42 for easy opening or can have a lock connection 43 that can facilitate easy opening of openable outlet 41.

In operation, liquid wastes 'L' and solid wastes 'S', collected in sink 11, are directed to flow to drainage pipe 20. Drainage pipe 20 is fitted in inlet hole 38 of storage box 30 releases liquid wastes 'L' and solid wastes 'S' in enclosed storage box 30. Upon release, solid wastes 'S' or objects accidentally falling in drainage pipe 20, such as hand ring, settles on the bottom of storage box 30. Openable outlet 41 can be opened periodically or as desired to remove solid wastes 'S' or objects. When the level of liquid reaches the level of drainage outlet 40, liquid wastes 'L' flows out from outlet hole 39 to drainage outlet 40 which are in-line and in fluid communication with each other.

Drainage system 10 for sink 11 eliminates the need to use sink plungers, drain snakes or cables for cleaning drainage pipes 20 and thus saves upon cost associated therewith. Also, as the usage of sink plungers, drain snakes or cables are eliminated, chocking further down the drainage pipes 20 are eliminated and prevents from major repair, thus saving on cost. Location and configuration of drainage system 10 prevents more solid wastes 'S' from entering drainage outlet 40 causing fewer blockages and thereby eliminates the need to call a plumber. Also, as the location of drainage system 10 is located at the back of sink 11, it is less likely to be damaged, typically while performing maintenance work or storing or removing objects/articles. Typically, 10 times more solid wastes 'S' are prevented from entering drainage outlet 40 than conventional drainage system 01. Drainage system 10 is also usable at commercial places, such as factories or shopping outlets, and openable outlet 41 is accessible while moving on a wheelchair.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A drainage system for a sink, said drainage system comprising:

a drainage pipe having a substantial portion longitudinal and connected to outlet of the sink to receive liquid and solid wastes; and a drainage box fitted on a wall underneath the sink and defined with an inlet hole to receive said drainage pipe configured to disburse liquid and solid wastes, an outlet hole in fluid communication with a drainage outlet provided on said wall for exit of liquid wastes and an openable outlet to remove solid wastes, said drainage box fitted to said wall by fasteners.

2. The drainage system as claimed in claim 1, wherein said drainage pipe is formed by an assembling a number of pipes with at least one of a connector such that said assembly has substantial portion longitudinal.

3. The drainage system as claimed in claim 1, wherein said drainage box includes:

a base fitted on said wall and defined with said inlet hole and said outlet hole and configured with a cavity; and a lid fitted with said base to enclose said cavity and obtain an enclosed area for receiving liquid and solid wastes, said lid configured with an openable outlet.

4. The drainage system as claimed in claim 3, wherein said lid is fitted to said base by fasteners.

5. The drainage system as claimed in claim 1, wherein said openable outlet is configured with a thread connection or a lock connection.

6. A drainage system for a sink, said drainage system comprising:

a drainage pipe having a substantial portion longitudinal and connected to outlet of the sink to receive liquid and solid wastes, wherein said drainage pipe is formed by an assembling a number of pipes with at least one of a connector such that said assembly has substantial portion longitudinal; and a drainage box fitted on a wall underneath the sink and defined with an inlet hole to receive said drainage pipe configured to disburse liquid and solid wastes, an outlet hole in fluid communication with a drainage outlet provided on said wall for exit of liquid wastes and an openable outlet to remove solid wastes, wherein said drainage box comprises:

i. a base fitted on said wall and defined with said inlet hole and said outlet hole and configured with a cavity; and ii. a lid fitted with said base to enclose said cavity and obtain an enclosed area for receiving liquid and solid wastes, said lid configured with an openable outlet, wherein said lid is fitted to said base and said drainage box is fitted to said wall by fasteners, wherein said openable outlet is configured with a thread connection or a lock connection.

* * * * *